United States Patent [19]

O'Dea et al.

[11] Patent Number: 4,955,483

[45] Date of Patent: Sep. 11, 1990

[54] MAIL HANDLING MACHINE WITH MIS-SEALED ENVELOPE DETECTOR

[75] Inventors: Kevin J. O'Dea, Sandy Hook; Francis E. McDermott, Watertown, both of Conn.

[73] Assignee: Pitney Bowes Inc., Stamford, Conn.

[21] Appl. No.: 291,099

[22] Filed: Dec. 28, 1988

[51] Int. Cl.[5] ..... B07C 5/00

[52] U.S. Cl. ..... 209/548; 209/546; 209/900

[58] Field of Search ..... 209/548, 549, 598, 600, 209/900, 546; 53/52, 266 A

[56] References Cited

U.S. PATENT DOCUMENTS

| | | | |
|---|---|---|---|
| 2,028,277 | 1/1936 | Finfrock | 91/43 |
| 2,944,511 | 7/1960 | Bach et al. | 118/243 |
| 3,792,209 | 2/1974 | Focke | 209/549 X |
| 3,901,797 | 8/1975 | Storace et al. | 209/900 X |
| 3,910,007 | 10/1975 | Dorer | 53/58 |
| 3,939,063 | 2/1976 | Epperson et al. | 209/598 X |
| 4,330,061 | 5/1982 | Rudszinat et al. | 209/3.1 |
| 4,428,794 | 1/1984 | Hayskar et al. | 156/442.1 |
| 4,450,037 | 5/1984 | Gavronsky | 156/442.2 X |
| 4,609,421 | 9/1986 | Yui | 156/442.1 |
| 4,766,715 | 8/1988 | Dimur | 53/381 R |

*Primary Examiner*—Russell D. Stormer

*Attorney, Agent, or Firm*—Charles G. Parks, Jr.; David E. Pitchenik; Melvin J. Scolnick

[57] ABSTRACT

In a mail-handling machine for processing mixed mail, a flap-stripper for opening the flap of an unsealed envelope is mounted for rotation to intercept and detect a mis-sealed envelope to avoid jamming the machine.

19 Claims, 8 Drawing Sheets

FIG. 11

```
INITIAL CASE ASSUMED TO BE CASE_0

CASE_0:   (AWAITING NEXT ENVELOPE TO STOP IN PAUSE POSITION)

    IF ENVELOPE STOPS
       THEN ENTER CASE_1      (SEAL ASSUMED OK SO FAR)

CASE_1:   (ENVELOPE STOPPED IN PAUSE POSITION)

    IF SENSOR SEES MAGNET     (ARM IS HOME)
       THEN START MOVING ENVELOPE USING NORMAL VELOCITY PROFILE
            ENTER CASE_3      (SEAL ASSUMED OK SO FAR)
       ELSE START MOVING ENVELOPE USING SLOW VELOCITY PROFILE
            TIME-OUT = X      (FOR STRIPPER ARM RETURN)
            ENTER CASE_2      (SEAL IS QUESTIONABLE)

CASE_2:   (ENVELOPE MOVING & ARM OUT)

    IF TIME-OUT = 0           (ARM CAUGHT IN FLAP)
       THEN HALT MOTION & INFORM USER OF JAM      (SEAL IS BAD)
       ELSE IF SENSOR SEES MAGNET  (ARM HAS RETURNED)
               THEN ENTER CASE_0   (SEAL OK)

CASE_3:   (ENVELOPE MOVING & ARM HOME)

    IF SENSOR LOSES MAGNET  (ARM CAUGHT IN FLAP)
       THEN HALT MOTION & INFORM USER OF JAM      (SEAL IS BAD)
       ELSE IF ENVELOPE HAS LEFT STRIPPER REGION  (SEAL OK)
               THEN ENTER CASE_0
```

MAIL HANDLING MACHINE WITH MIS-SEALED ENVELOPE DETECTOR

FIELD OF THE INVENTION

This invention relates to mail handling machines, and in particular to mail handling machines for processing mixed mail including sealed and unsealed envelopes.

BACKGROUND OF THE INVENTION

Co-pending application, Ser. No. 291,483, describes a mail machine for high speed processing of mixed mail, which includes unsealed as well as sealed envelopes. The mail flow in such a machine typically begins at a hopper where the incoming mail to be processed is stacked. The main flow path continues through a singulator, which separates individual mail pieces from the stack for serial processing. Following the singulator, the envelopes are caused to flow along the main path through a moistener which moistens the glue on the flaps of the unsealed envelopes and then seals the envelopes, and thereafter along the main path to a weigher and printer including a postage meter. The machine is intended to handle mixed mail, by which is meant unsealed envelopes with the flaps open in the position for moistening, unsealed envelopes with the flap closed and which has to be opened by the machine to the moistening position, and already-sealed envelopes.

In this environment it is important to detect the presence of mis-sealed envelopes, that is envelopes in which the sealed edge, instead of lying flet, may protrude outwardly or display other undesired anomalous leading edge states. If allowed to continue along the main flow path, such mis-sealed envelopes may jam the machine.

SUMMARY OF INVENTION

An object of the invention is to provide apparatus for distinguishing between properly sealed and improperly or missealed envelopes.

A further object of the invention is a mail handling machining for processing mixed mail and provided with means for detecting and differently processing mis-sealed flapped envelopes.

Still another object of the invention is a mailing machine in which mixed mail is serially processed and provided with means for temporarily slowing mis-sealed mail and for taking special measures for handling such mis-sealed mail These and other objects and advantages as will be apparent from the following description are achieved in accordance with one aspect of the invention by positioning in the main flow path of the mixed mail being processed a mean for distinguishing between properly sealed, unsealed-with-flap-closed unsealed-with-flap-open, and mis-sealed envelopes. It is one of the surprising results of this aspect of the invention that essentially mechanical means can be provided to perform this function.

In accordance with another aspect of the invention, the mis-sealed envelope detector is combined with a flap stripper, the device which moves the flap of an unsealed envelope from its closed to its open position. By integrating the two functions, less space is used in the machine, and the overall length of the machine can be reduced.

In a preferred embodiment, a biased pivotable member is positioned in the main flow path. The pivotable member is shaped to perform the flap stripping function, and is biased so that it does not move during a real flap stripping operation. However, the biasing is such that the pivotable member is forced out of the flow path by an oncoming mis-sealed envelope. This movement can be detected and used temporarily to slow the processing or to inform an operator that potentially jamming envelopes are in the main flow path and precautions should be taken.

In accordance with still another aspect of the invention, the mis-sealed envelope detector is associated with apparatus located downstream of the singulator but upstream of the moistener and which functions to position the flap of the unsealed envelopes at an orientation ready for the moistening operation. Thus, both the treatment of the unsealed and properly sealed envelopes and the detection of the mis-sealed envelopes take place at the same station. This conserves space and speeds up the processing.

SUMMARY OF DRAWINGS

A preferred embodiment of the invention will now be described in connection with the accompanying drawings, wherein:

FIG. 11 lists an example of pseudocode for a programmable controller to handle the envelope flow through the flap detector station.

DETAILED DESCRIPTION OF PREFERRED EMBODIMENTS

Figure 1A:
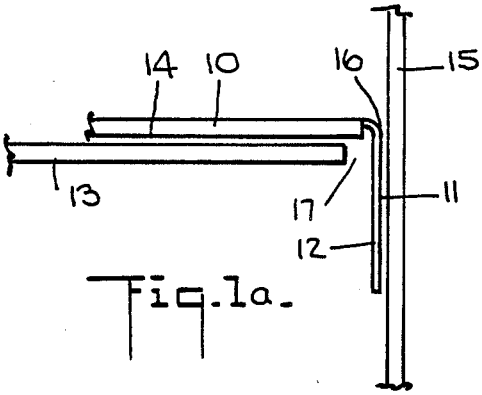
FIG. 1*a*–1*d* are end view schematics of the different species of mixed mail required to be handled by the machine.

FIG. 1 schematically illustrates examples of mixed mail that the apparatus of the invention can handle. FIG. 1*a* depicts an unsealed envelope 10 whose flap 11 is open. In this position water can be sprayed onto the flap glue line 12 and the flap subsequently sealed. In such a machine typically the envelope is being transported across a deck 13 contacted by the bottom surface 14 of the envelope, and along a registration side wall 15 contacted by the fold edge 16 of the envelope. The flap in this downward position typically rides in a slot 17 between the registration wall and the deck edge. The deck 13 and wall 15 have been shown spaced from the envelope for clarity.

Figure 1B:
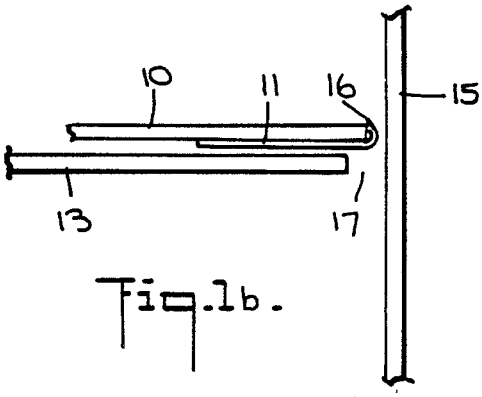

FIG. 1*b* shows a properly sealed envelope 10, with the flap 11 glued down tight to the envelope body. In this case, the flap will contact the deck 13.

Figure 1C:
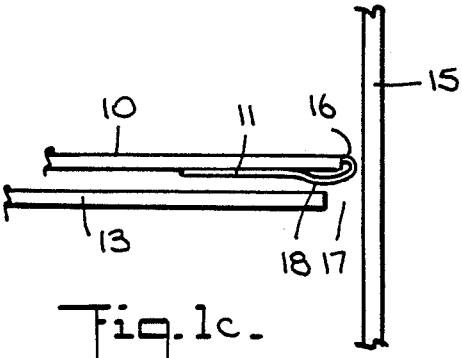

FIG. 1*c* shows a sealed envelope 10 that was improperly sealed, typically because the flap bulges as shown at 18.

Figure 1D:
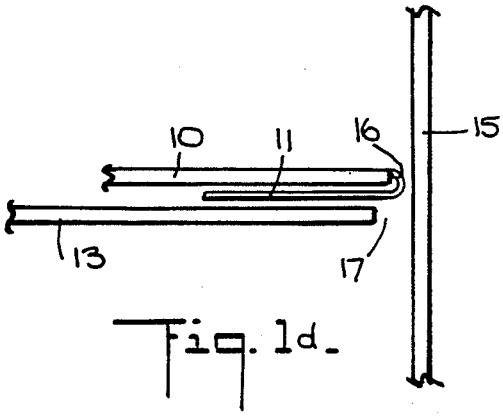

FIG. 1*d* shows an unsealed envelope 10 with the flap in a closed position.

The machine process the four kinds of mail shown differently. When the envelope in FIG. 1*a* comes through, a sensor detects the flap in the slot and primes the moistener to operate. The envelope in FIG. 1*b* should encounter no obstacles and pass through the moistener and sealer without being processed. The envelope in FIG. 1*c* will likely jam the machine modules downstream; therefore it must be detected and handled specially. The envelope in FIG. 1*d* must have its flap stripped open and pushed into the slot 17, so it appears as depicted in FIG. 1*a* and is processed the same way.

Figure 2:
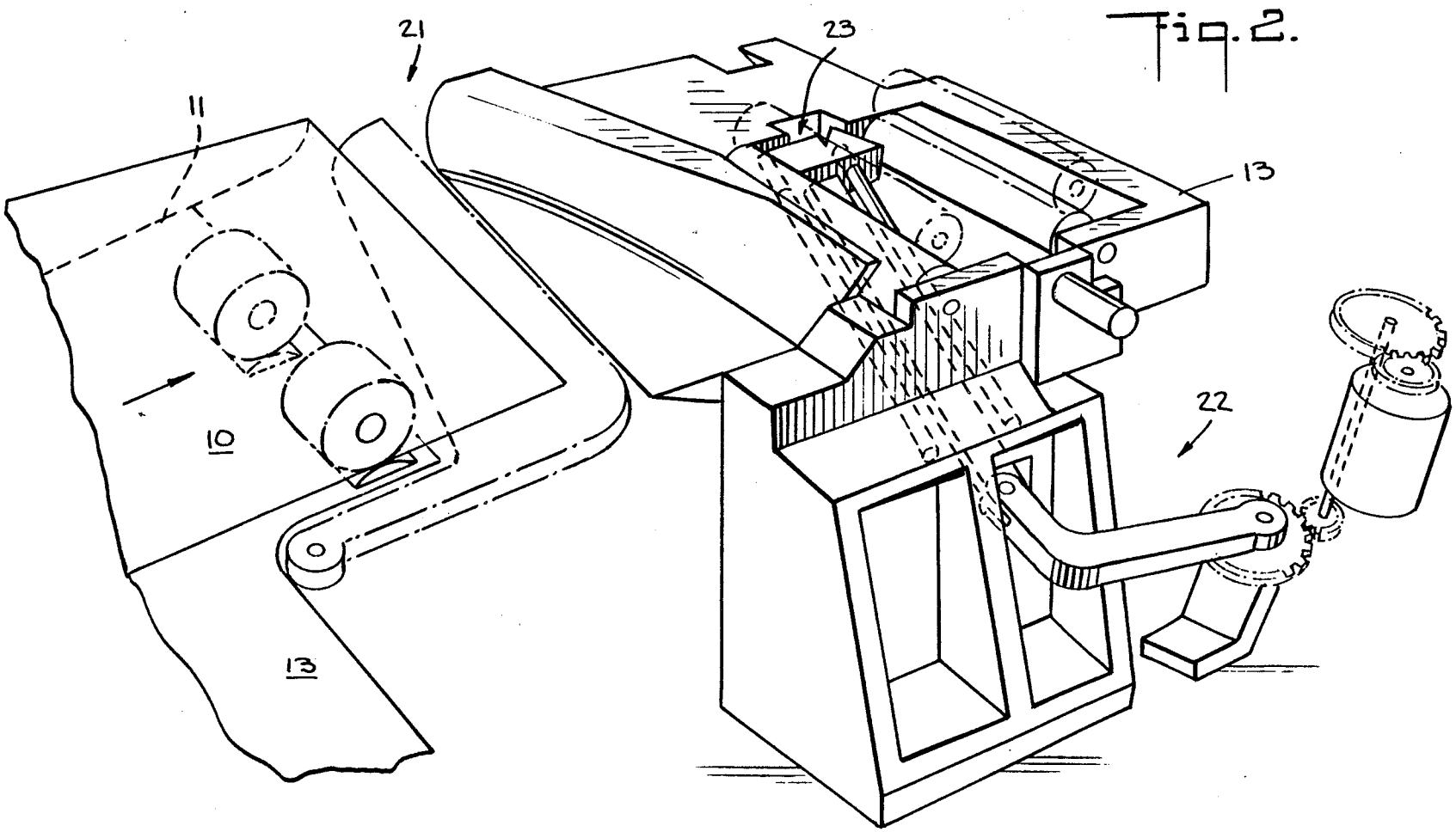
FIG. 2 is a perspective view of one form of the apparatus according to the invention, in relation to the downstream moistening module.

FIG. 2 shows the setting of the apparatus of the invention in the mail handling machine. Envelopes 10 are transported across a deck 13 by conventional transport means 20. The flap continues along the machine deck where the profile of the open flap is taken to control a moistener 22 whose spray nozzle 23 is positioned under the deck 13, and the envelope then proceeds downstream to the sealer. The moistener and sealer only become activated when an envelope appears whose flap is located in the slot 17. Properly sealed envelopes flow right through stations 21 and 22 without interruption.

Figure 4:
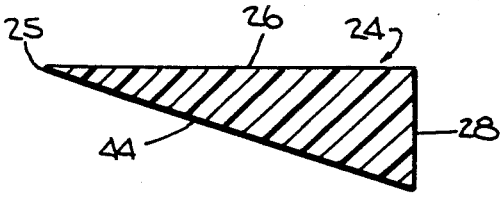
FIG. 4 is a cross-sectional view of the flap-stripping blade taken along the line 4—4 of FIG. 5.
Figure 3:
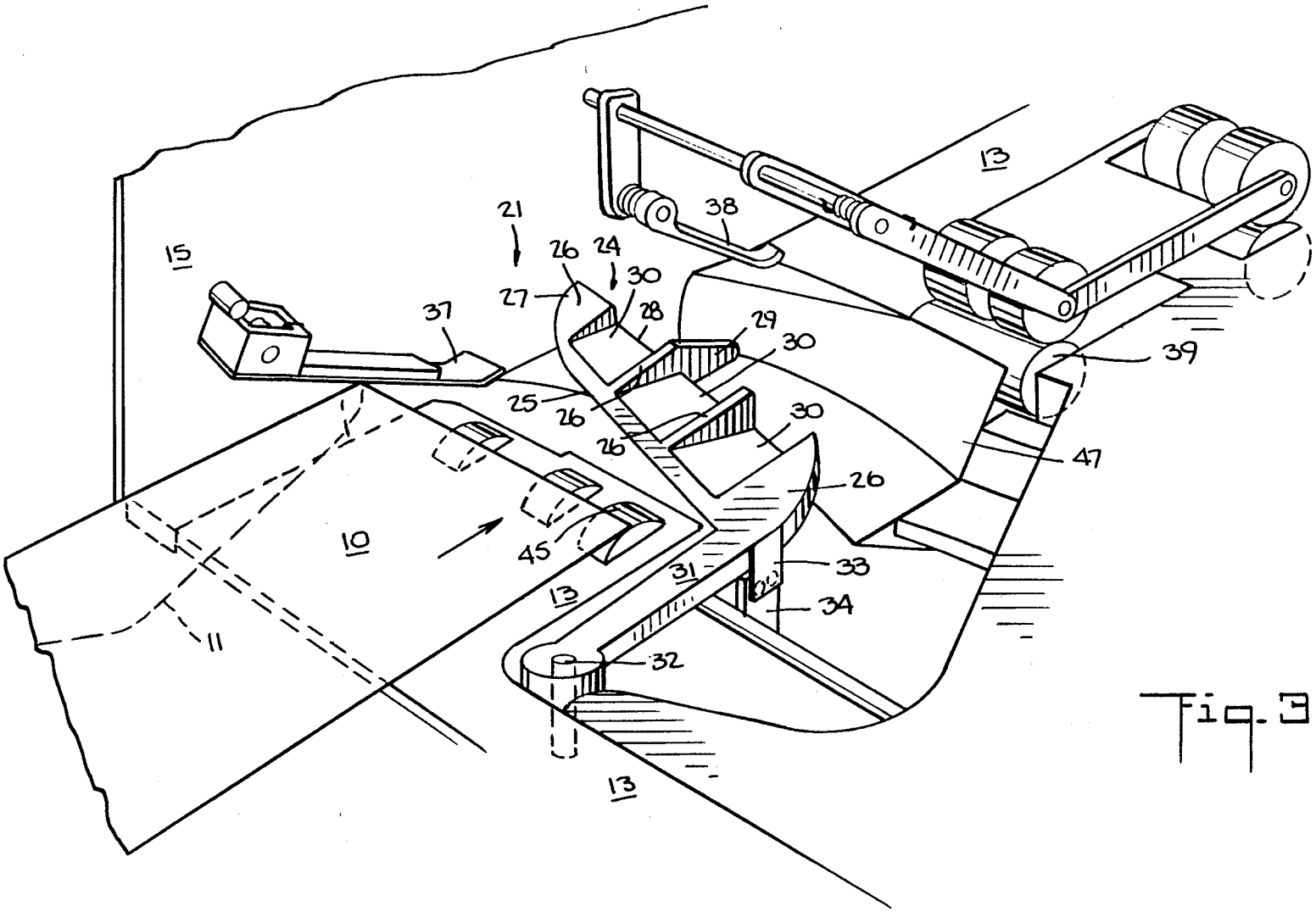
FIG. 3 is a perspective view from the top of the flap stripper and mis-sealed flap detector station of the invention shown in FIG. 2.

FIG. 3 shows in greater detail the construction of station 21, a key feature of which is a pivotably-mounted, airfoilshaped blade 24 which has a wedge-like cross-section, depicted in FIG. 4. The blade 24 has a sharp front edge 25, flat top sections 26 in line with the deck 13, which optionally may be separated by cut-out areas 25, and an end 27 that curves downstream. The back side 28 is flat except for a downstream extension 29 which is used to support and position the blade 24.

The blade 24 has an upstream transverse arm extension 31 which is pivotably mounted 32 on the machine deck 13. The blade 24 can be made of plastic or other material. Extending downward from and affixed to the blade is a magnet 33. A Hall-effect device 34 is mounted on the machine bed. A torsion spring 36 (FIG. 5) biases the blade 24 towards a closed position as shown in FIG. 1, in which magnet 33 is adjacent the Hall-effect detector 34. The latter acts as a sensor to detect position and/or movement of the blade 24. A biased finger 37 is mounted on the registration wall 15 and pushes the mail flap edge, if unsealed, down toward the deck to pucker the flap from the envelope so that it may be stripped for moistening. A similar biased finger 38 also helps keep the envelope down against the deck 13 which continues downstream driven by the roller drive 19.

Figure 5:
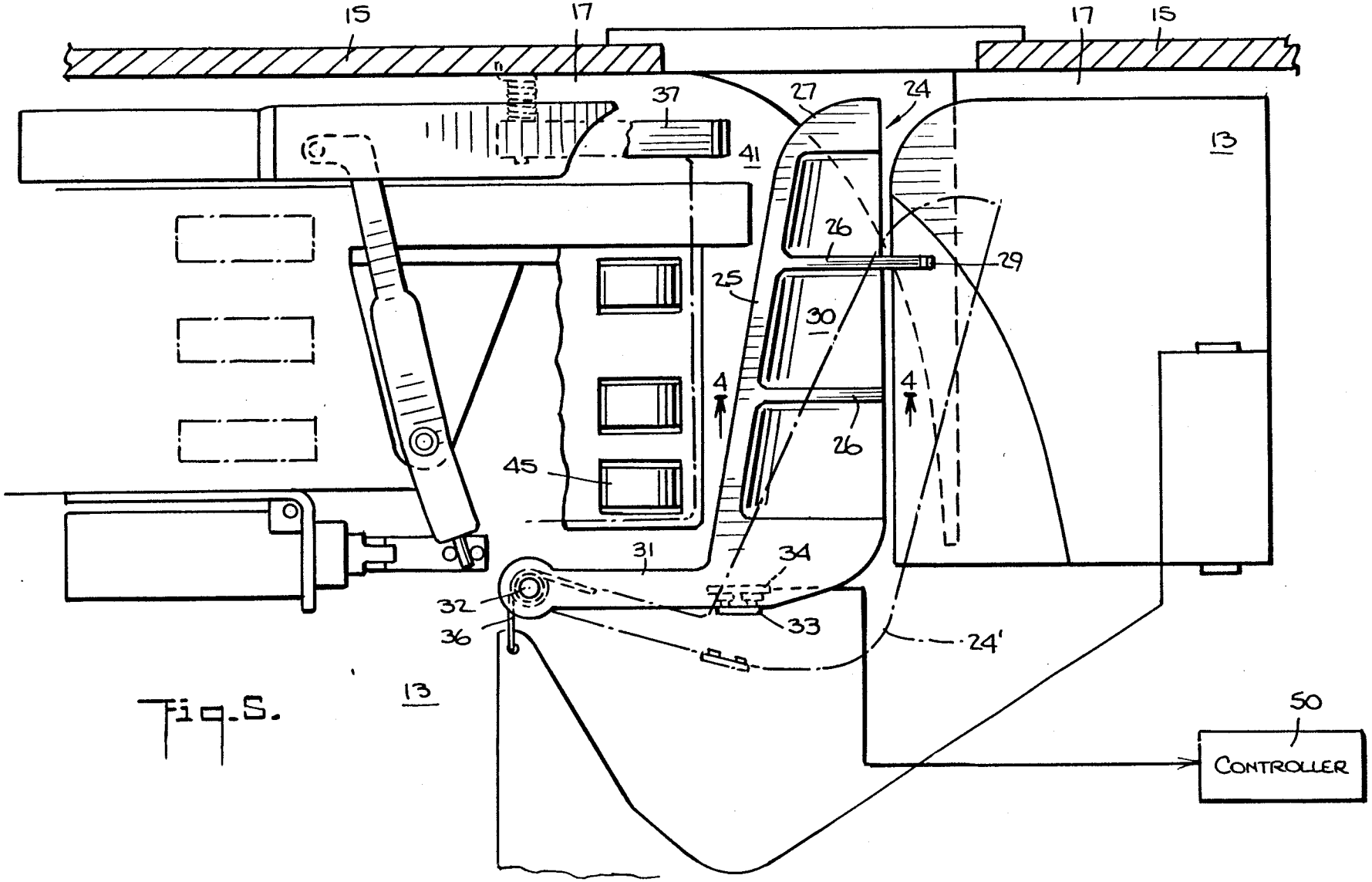
FIG. 5 is a top view of the station illustrated in FIG. 3.

FIG. 5 illustrates the motion of the blade 24. In solid lines it is shown in its closed position, with magnet 33 in one will rotate CW to the partially open position 24' shown in phantom, typically about 10°. However, an operator can manually rotate the blade about 90° CW to a completely open position where it is completely out of the mail path flow. In both the partially and completely open positions, the sensor 34 is switched to its opposite state.

Figure 6:
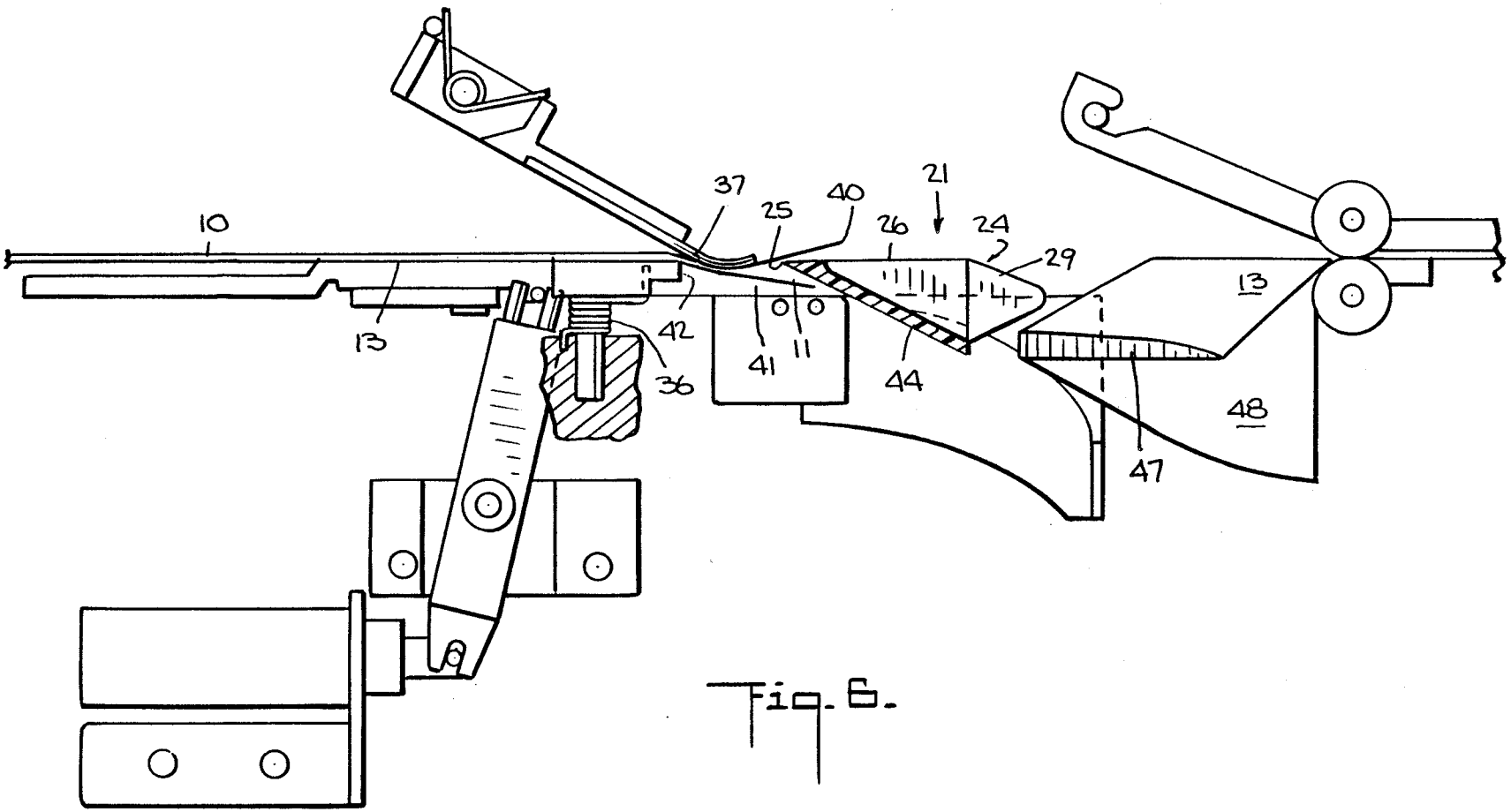
FIG. 6 is a side view from the front of the station illustrated in FIG. 3 during a flap-stripping operation.

The blade 24 profile is shaped such that when the unsealed envelope shown in FIG. 1*d* reaches this station, as illustrated in FIG. 6, the finger end 37 pushes down the envelope leading edge 40 as it crosses a gap 41 between a dock edge 42 and the front edge 25 of the blade. This action causes the flap 11 to separate or open wider, and it is forced under the angled bottom surface 44 on the blade, the main body of the envelope continuing over the top surface 26. The gap 41 opens (FIG. 5) to the slot 17 upstream, and the slot 17 downstream. The continued forward movement of the envelope 10, by the drive 45, therefore causes the flap 11 to follow the bottom surface 44 and is gradually forced into a generally vertical position and enters the downstream slot 17, positioned to undergo moistening. The curved shaped at the end 27 of tha blade (FIG. 5) assists in achieving this desired flap position. The shaped structure 47 which is affixed to the deck just downstream of the blade 24 also assists in directing the flap into tha slot 17, the flap passing under a curved wall 48 extending down from the structure 47. During this entire flap-stripping operation, the blade 24 remains in its closed position. The spring 36 tension is chosen so that the force required to strip open the flap does not exceed the spring tension. Thus, no signal is sent from the sensor 34 to the machine controller, depicted at 50.

Figure 7:
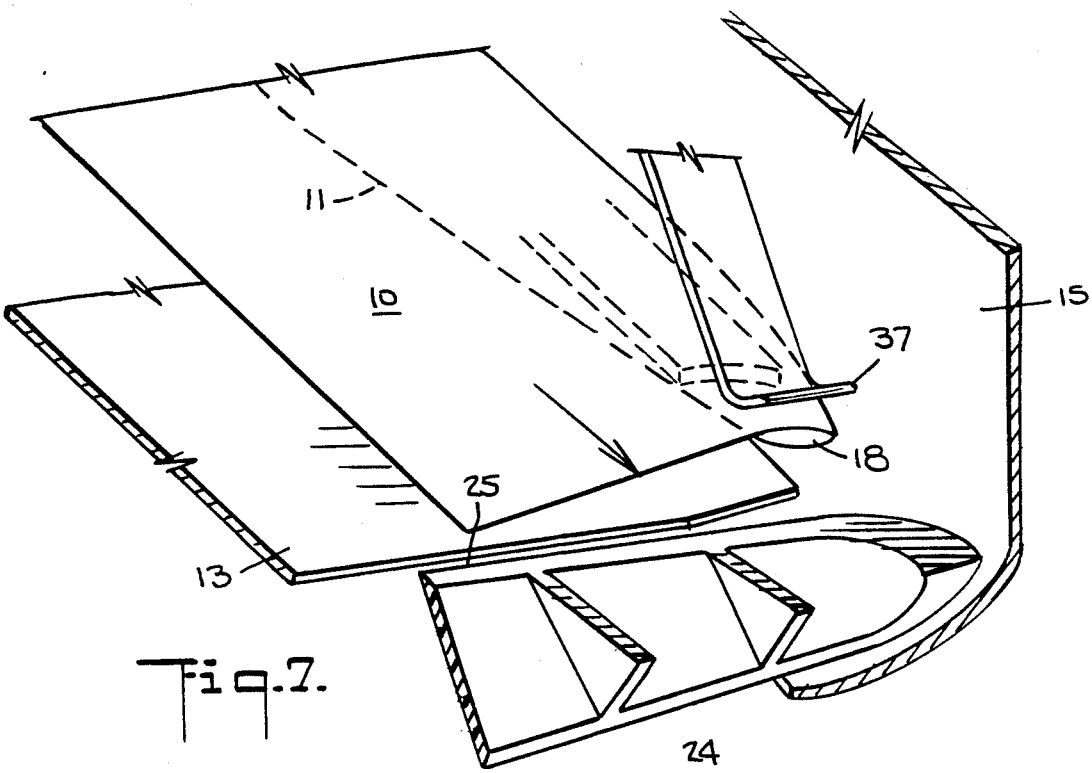
FIGS. 7–10 are perspective views showing operation of the mis-sealed flap detector when mis-sealed and properly sealed envelopes are driven past.
Figure 8:
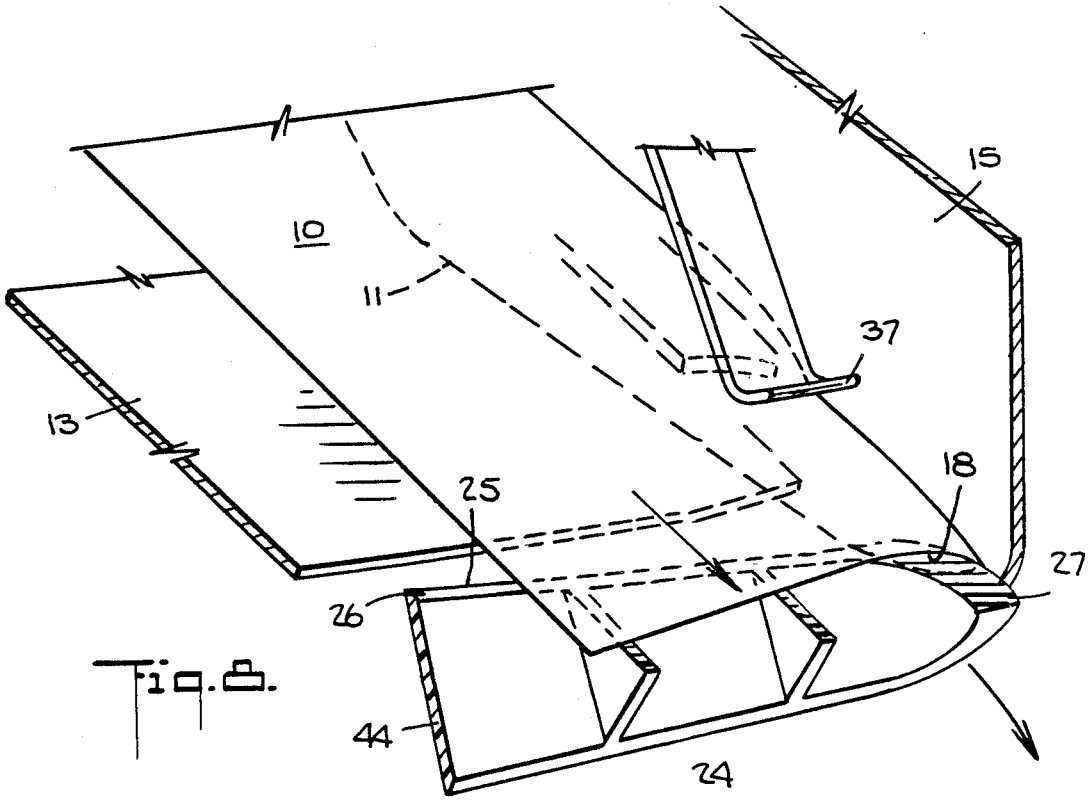

Now, when a mis-sealed envelope as depicted in FIG. 1*c* comes along, as shown in FIG. 7, the bulge 18 which tends to open due to the pressure of finger 37, will be intercepted by the blade edge 25, which will try to strip open the flap 11 This is shown in FIG. 8. Since tha latter is sealed, instead the spring tension is overcome and the arm starts to swing away as shown by the arrow. After about a 10° rotation, the sensor 34 will switch states and send a signal to the controller 50. While it is possible to substitute an electrical switch for the magnetic detector 34, the typical electrical switch will actuate as soon as the arm 24 begins to rotate. By using a magnetic switch, the sensor doesn't switch states until the magnet has moved at least a short distance away. This avoids undesired switch actions due to small movements of the blade 24 when no mis-sealed envelope is present.

Figure 9:
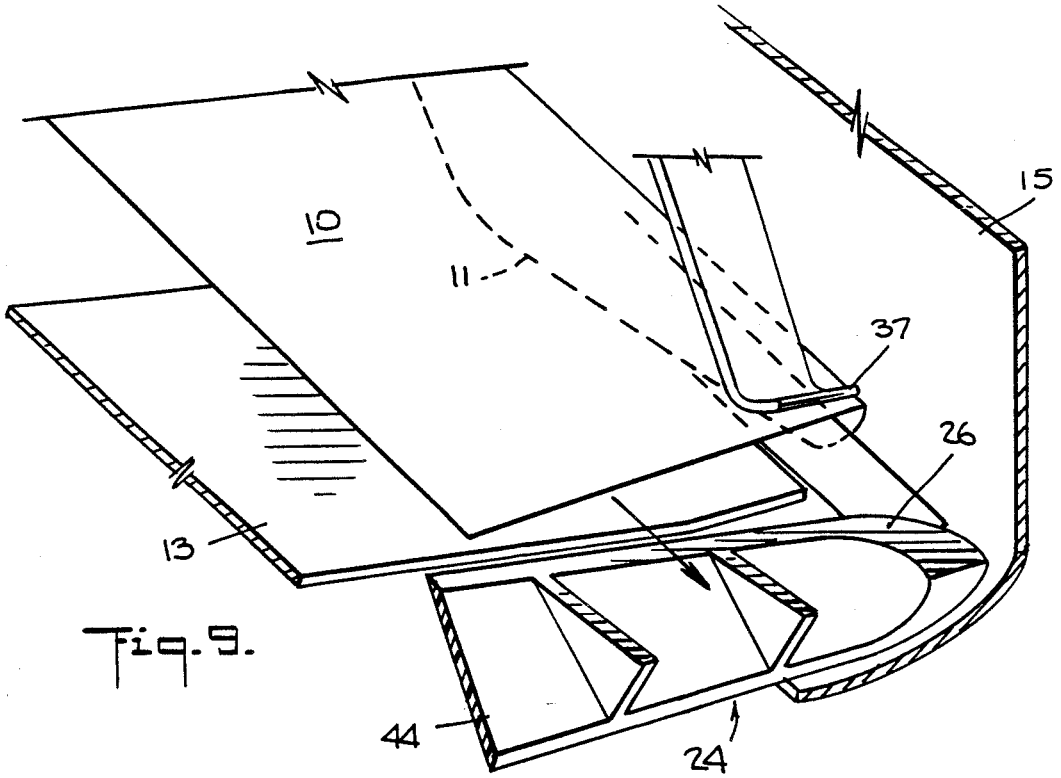
Figure 10:
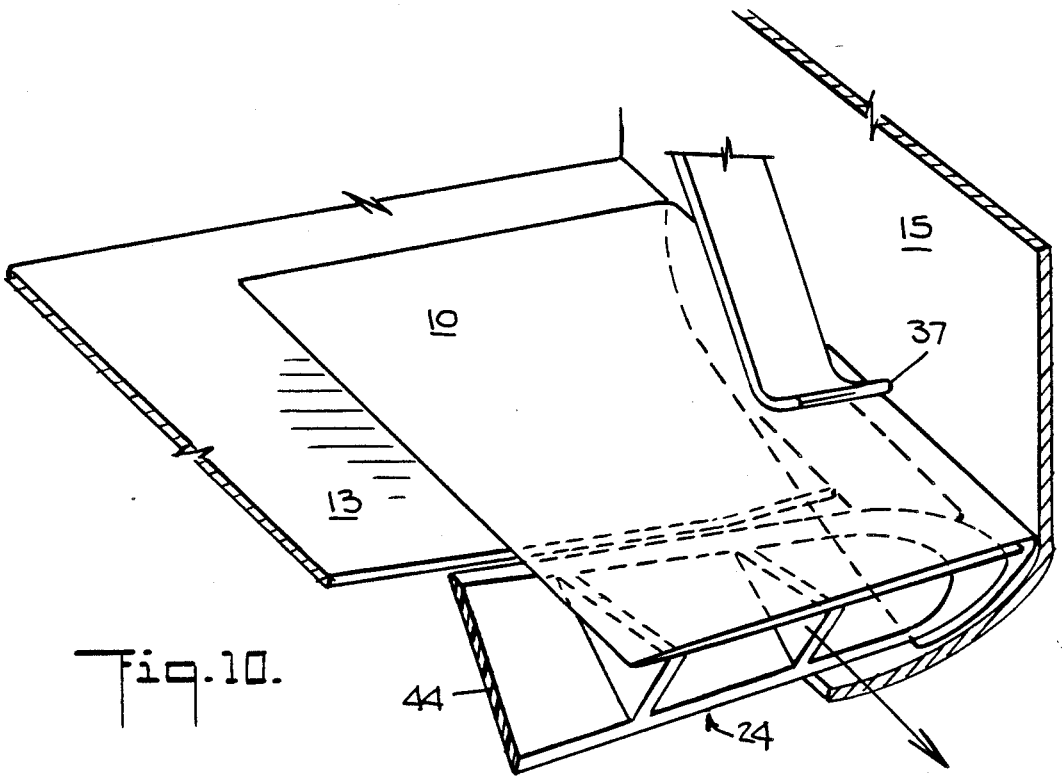

FIGS. 9 and 10 illustrate what happens when a properly sealed envelope as depicted in FIG. 1*b* comes along. In this case, no bulge is present and the sealed flapped edge as well as the envelope body pass smoothly over the top surface of the blade 24 without activating it. In other words, the blade 24 remains in its closed position.

When the sensor has been activated and sends a signal to the controller, several ways exist to handle the situation. The simplest is for the controller to stop the machine, and signal the operator that a mis-sealed envelope is encountered, in which case the operator would manually swing the blade 24 out of the way, and reach in and remove the mis-sealed envelope. Alternatively, when the mis-sealed envelope is intercepted by the blade 24 and becomes stuck, causing the blade to rotate and activating the sensor, the controller can be programmed to slow down the forward drives 45 for the envelope for several microseconds. If the bulge 18 is not too large, then the envelope can become unstuck and continue downstream, thus allowing the blade to swing the temporary jam has ended and allowing processing to continue. If the envelope can succeed in passing the structure 47, it is not likely to cause a jam downstream in the machine.

A preferred way of handling the situation when the stripper blade opens is by means of suitable programming of the microcontroller 50. In particular, three possible events can occur: (1) the envelope passes straight through without budging the blade 24 which remains in its home or closed position; (2) the envelope has a small bulge which opens the blade 24 but the envelope doesn't get stuck and continues downstream in which case the spring-biased blade 24 returns to its closed position; this is acceptable; and (3) the envelope gets stuck on the blade and doesn't proceed downstream.

The microcontroller 50 which controls the drives as explained in the copending application is readily programmed to handle intelligently the three possibilities enumerated above. One suitable program in pseudocode is illustrated in FIG. 11, which will be best understood also with reference to FIG. 3. In the normal operation of the machine, assuming perfect envelope flow, the upstream envelope 10, before it reaches the flap stripping station 21 and while still under control of the takeaway nip of the singulator (the so-called post-nip position , is temporarily stopped or paused by the controller awaiting completion of the processing of the preceding downstream envelope. The program commences with an initial state designated CASE_0, in which it waits for an envelope to reach the post-nip or pause position. Due to the dimensioning of the machine, when the envelope is in the post-nip position, the envelope's leading edge will have reached the blade 24. Two possibilities exist. The envelope edge has not budged the blade 24, or it has. Returning now to the program, when an envelope reaches the post-nip position, detected by a sensor, then the program flow drop down to state CASE_1. If the blade has not moved, i.e., the blade 24 or arm as referred to in FIG. 11 is in its home or closed position, then everything is OK and the drives are activated to move the envelope to the next station 13, and program control drops through to CASE_3.

While still in CASE_1, if, on the other hand, the blade has budged and moved to its open position, then the ELSE statement tells the controller to activate the drives with a slower-than-normal velocity profile while starting a time (TIME-OUT) to count down from an assigned value X based on how long it should take for the blade 24 to return to its closed position if event (2) has occurred, a minor bulge that is acceptable and will allow the envelope to proceed downstream and undergo normal processing, rather than event (3). The reduced velocity, in effect, provides increased time to allow tha machine to recover, if it can, from what may be only a temporary glitch, without a significant sacrifice in throughput. Program control then passes to CASE_2 to distinguish these two elements (2) and (3) wherein the counter state is tested. If it times-out and the blade 24 has not yet returned to its closed position, then event (3) is assumed, the controller shuts down the drives, the machine stops, and the user is informed of a jam and the steps to take to clear the jam, essentially to remove the stuck envelope. Otherwise, in the ELSE statement, if the blade 24 has returned before the counter timed out, then everything is OK, the envelope is now at the downstream station and control returns to CASE_0.

Finally, CASE_3 is provided to cover the possibility of a flap only sealed at the rear part of the envelope, but not at the front part. In this situation, while at state CASE_1, the open part of the flap at the front will not move the blade 24, and as mentioned above, the envelope is then advanced normally and control falls through to CASE_3. If, then, the arm 24 is suddenly opened, because the rear sealed part of the flap catches the arm, then the machine is stopped and the user informed to take antijam action; otherwise, if the arm remains closed then everything is OK and control returns to the initial state CASE_0.

It will be clear from the foregoing to those skilled in this art that other programs can readily be devised to perform the above-described functions of distinguishing the three events mentioned. Moreover, if desired, hardwired logic circuitry can instead be provided to perform the same functions.

When the flap is stripped open into the downstream slot 17, it need not occupy a vertical position. Preferably the flap is forced up against an angled wall which houses tho flap profiler in a position that allows the moistener underneath to spray the flap glue line.

By combining the flap-stripping and mis-sealed envelope detecting functions at a single station within the mail-handling machine, space is conserved and subsequent jamming of the machine is avoided. This allows the machine to handle a large variety of mixed mail, and to be operated at higher speeds to increase its throughput of properly sealed envelopes.

What is claimed is:

1. In a mail handling machine having means for serially transporting along a main path sealed and unsealed close-flapped and open-flapped envelopes some of which may be is-sealed envelopes and means along the mainpath for moistening the flaps of the unsealed envelopes, the improvement comprising detection means upstream of the moistening means for detecting mis-sealed envelopes, said detecting means having means positioned to be engaged and moved by the mis-sealed flap of a sealed envelope, and signal means for generating a signal indicative of the detection of a mis-sealed envelope, said signal means responsive to the moved movable means.

2. The mail handling machine of claim 1 wherein the movable means comprises a shaped blade pivotably mounted on the machine and located along the main path

3. The mail handling machine of claim 2 wherein the blade is configured to strip open the flap of an oncoming envelope having a closed, unsealed flap.

4. The mail handling machine of claim 2 wherein the blade has an air-foil shape with a forward edge for engaging the envelope flap.

5. The mail handling machine of claim 4 wherein the blade has a flat top surface over which the envelope body passes.

6. The mail handling machine of claim 5 wherein the blade is mounted for pivoting in a plane parallel to the envelope plane.

7. The mail handling machine of claim 2 wherein means are provided to bias the shaped blade toward a position where it extends substantially transverse to and in the first path.

8. The mail handling machine of claim 7 wherein the blade is mounted for pivoting completely out of the first path for removing mis-sealed envelopes.

9. The mail handling machine of claim 7 wherein the detecting means comprises a magnetic sensor.

10. The mail handling machine of claim 1 wherein the machine includes a controller, and the responsive means informs the controller that the envelope currently at the detecting means is mis-sealed.

11. The mail handling machine of claim 10 wherein the machine includes a forward drive for the envelopes, and in response to a signal from the responsive means, the controller stops or slows the envelope forward drive.

12. The mail handling machine of claim 1 wherein the machine includes upstream of the detecting means a finger for pressing the flapped side of the envelope downward.

13. The mail handling machine of claim 12 wherein the machine includes a deck, the detecting means has a top surface aligned with the top of the deck but spaced downstream from a deck edge to form a gap, and the finger is positioned to bias the leading edge of an oncoming envelope into the gap.

14. The mail handling machine of claim 13 wherein the deck has a shot for receiving the open flap of an unsealed envelope, the slot opens into, the said gap, and the detecting means is a blade-shaped body configured to force an open flap into the deck slot downstream of the blade.

15. A method of processing mixed mail including sealed and unsealed flapped envelopes some of which may be mis-sealed envelopes comprising:

(a) providing in the mail path flow means to intercept a possible mis-sealed envelope, (b) advancing an envelope toward the intercept means, (c) reducing the velocity of the advancing envelope when the intercept means detects a possible mis-sealed envelope, (d) stopping the envelope if and when the arm has not returned to its home position within a predetermined interval.

16. A method of processing mixed mail including sealed and unsealed flapped envelopes some of which may be mis-sealed envelopes comprising:

(a) providing in the mail path flow an arm having a home position and configured and positioned while in that home position to intercept a closed but unsealed flap to strip open the flap and to intercept a possible mis-sealed envelope and be moved from it home position, (b) advancing an envelope toward the movable arm, (c) reducing the velocity of the advancing envelope when the arm moves from its home position, (d) stopping the envelope if and when the arm has not returned to its home position within a predetermined time interval.

17. A method as set forth in claim 16 wherein the envelope is advanced at a high velocity when the arm has not moved, and at a lower velocity when it has moved.

18. A method as set forth in claim 16 wherein the envelope is advanced at a high velocity when the arm has not moved, and thereafter the envelope is stopped when the arm moves.

19. A method as set forth in claim 16 wherein a timer is started when the arm moves, and if the arm has not returned to its home position when the timer times-out the envelope is stopped.

* * * * *